United States Patent [19]

Greene et al.

[11] Patent Number: 4,809,766

[45] Date of Patent: Mar. 7, 1989

[54] CONTINUOUS CASTER BREAKOUT DAMAGE AVOIDANCE SYSTEM

[75] Inventors: Timothy R. Greene, Pine Township, Porter County; Jerry D. Oberlander, Westchester Township, Porter County; Richard O. Ostertag, Portage Township, Porter County; Frank Vavra, Ross Township, Lake County, all of Ind.

[73] Assignee: USX Corporation, Pittsburgh, Pa.

[21] Appl. No.: 198,899

[22] Filed: May 26, 1988

[51] Int. Cl.[4] ..... B22D 11/16

[52] U.S. Cl. ..... 164/151; 164/154; 164/452

[58] Field of Search ..... 164/4.1, 451, 452, 150, 164/151, 152, 153, 154, 418

[56] References Cited

U.S. PATENT DOCUMENTS

| | | | |
|---|---|---|---|
| 3,537,505 | 11/1970 | Thalmann et al. . | |
| 3,592,773 | 7/1971 | Vogt et al. . | |
| 3,834,445 | 9/1974 | Raschke | 164/150 |
| 3,939,568 | 2/1976 | Gonos et al. | 33/143 |
| 4,090,549 | 5/1978 | Ives et al. . | |
| 4,542,781 | 9/1985 | Kreyenhop | 164/451 |
| 4,553,604 | 11/1985 | Yaji et al. | 164/453 |
| 4,607,681 | 8/1986 | Tinnes et al. | 164/453 |

FOREIGN PATENT DOCUMENTS

| | | | |
|---|---|---|---|
| 39-17504 | 8/1964 | Japan | 164/451 |

*Primary Examiner*—Kuang Y. Lin

*Attorney, Agent, or Firm*—W. F. Riesmeyer, III

[57] ABSTRACT

Apparatus is provided for giving an early warning of the occurrence of breakout of molten metal from a partially solidified cast strand downstream from a continuous caster mold. The apparatus includes a hollow body (preferably tubing) located adjacent to the strand. A source of fluid connected to the body is adopted to maintain substantially constant pressure of the flue therein. A monitoring device provides a signal when a significant drop in fluid pressure occurs in the body, so that an early warning of the breakout of molten metal and resultant fusion and opening of a hole in the wall of said body is provided.

10 Claims, 2 Drawing Sheets

CONTINUOUS CASTER BREAKOUT DAMAGE AVOIDANCE SYSTEM

BACKGROUND OF THE INVENTION

This invention relates to apparatus for minimizing damage to a continuous caster due to breakout of molten metal from a partially solidified casting at a location downstream from the mold, and particularly to apparatus for providing a signal giving early warning of breakout of molten metal from the strand at a location adjacent to a downstream end of the mold.

In the continuous casting of molten steel, breakouts sometimes occur where liquid steel from the core of a partially solidified cast strand leaks out through a break in the skin at a location just downstream from the mold. When this happens considerable damage can be caused to the rolls and other equipment below the mold, especially if the caster operator is not made aware of the breakout until substantial quantities of liquid steel pour out from the strand onto said equipment. The resultant damage significantly increases the amount of downtime of the caster required for repair and restart of caster operation. It is desirable to obtain an early warning of the breakout of molten steel from the cast strand below the mold so as to minimize equipment damage and downtime of caster operation.

U.S. Pat. No. 3,834,445, Raschke discloses apparatus for providiang early warning of breakout of molten metal below a continuous caster mold. The apparatus includes a protective body resistant against molten metal located immediately below the mold. The body is provided with a cavity open towards the shell of the cast strand for receiving liquid metal therein. In the cavity a sensor is provided in the form of a wire which is electrically connected to one pole of an alternating current power supply. The other pole of the power supply is connected to a line leading to an alarm. When liquid steel breaks through the shell it collects in the cavity and closes a circuit between the wire and the body on the strand and the mold so that the alarm is actuated. A disadvantage of this apparatus is that the body may require circulation of cooling water to prevent damage to it by heat from the strand prior to a breakout. Also, the body is part of a permanent fixture beneath the mold and may be cumbersome to replace in the event of damage by a breakout.

U.S. Pat. No. 3,593,773 discloses a pipe having an opening for receipt of steam emitted within an enclosed area from the core of a cast tubular shaped strand. The pipe transmits pressure to a measuring device which detects pressure changes that may indicate abnormalities such as the formation of cracks in the strand beneath this mold.

Other patents pertinent to the field of this invention are U.S. Pat. Nos. 3,537,505; 4,542,781; 4,553,604 and 4,607,681.

SUMMARY OF THE INVENTION

The primary object of this invention is to provide a simple device which overcomes the disadvantages of the prior art and provides an accurate early warning of the breakout of molten metal from a partially solidified strand immediately downstream from a continuous caster mold. The apparatus includes a hollow body positioned downstream from the mold adjacent to the cast strand. The hollow body has a melting point sufficiently below that of the molten metal being cast and is of sufficiently thin wall thickness so as to fuse and form a hole through said wall thereof upon being contacted by molten metal from the strand when a breakthrough has occurred. Means are connected to the hollow body for supplying fluid to the interior of the body at a substantially constant pressure. The fluid supply means includes means for monitoring the pressure of fluid in said body and providing a signal indicating when a significant drop in the fluid pressure has occurred. The apparatus provides a simple, reliable device for giving an early warning of a breakout of molten metal from the strand immediately downstream from the mold.

DESCRIPTION OF THE PREFERRED EMBODIMENT

Figure 1:
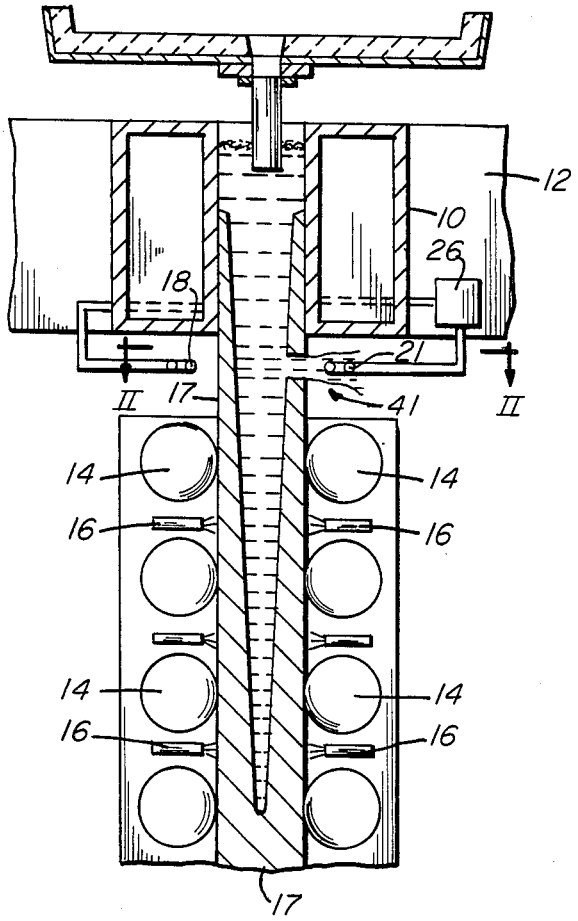
FIG. 1 is a side elevation view of part of continuous caster mold and roll apparatus there beneath together with the apparatus of this invention.

Referring to FIG. 1, a portion of a conventional continuous caster is shown including a mold 10 mounted in a mold frame 12. Rolls 14 are provided for support of a partially solidified strand of molten metal as it emerges from the mold. Spray pipes 16 flow cooling water onto the surface of the strand 17 below the mold to further cool and completely solidify the strand.

According to this invention, tubing is provided at a location adjacent to the partially solidified strand just below the mold. The tubing may consist of a single tube encircling all or most of the strand or a first pair of tubes 18 and 19 may be provided. Most preferably, a second pair of tubes 20 and 21 are also provided as part of a backup system as further described below. It is essential that the tubing has a melting point below that of the molten metal being cast and a sufficiently thin wall thickness so as to readily fuse when contacted molten metal in the event of breakout from the strand. Desirably the tubing is spaced slightly from the strand and extends longitudinally in a transverse direction of the strand. Conceivably the tubing may be of various metallic and non-metallic materials including plastic. Preferably, for the continuous casting of steel the tubing material is selected from the group consisting of copper, copper alloys, aluminum, aluminum alloys, and mixtures thereof. Most preferably when casting, steel copper or copper alloy tubing is used. We use ASTM B75-66 copper tubing of ¼ outside diameter and 0.032 inch wall thickness. Preferably, the wall thickness of the tubing should be within a range of 0.015 to 0.050 inches. Fluoride mold flux materials sometimes used when casting steel form acids that corrode aluminum and aluminum alloy material. In the most preferred form, spaced pairs of tubing are provided adjacent opposed faces of the strand.

Figure 2:
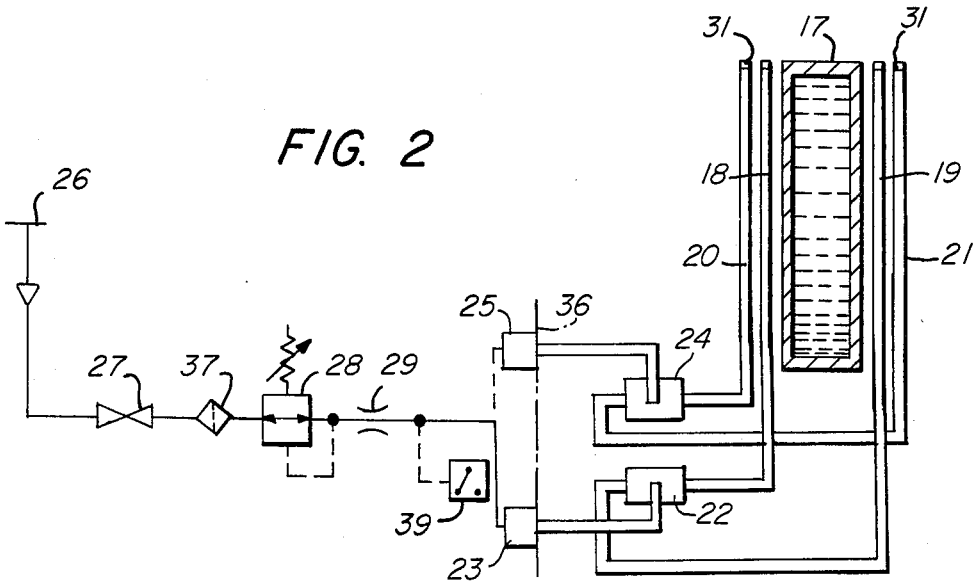
FIG. 2 is a schematic circuit diagram of the apparatus of this invention.
Figure 3:
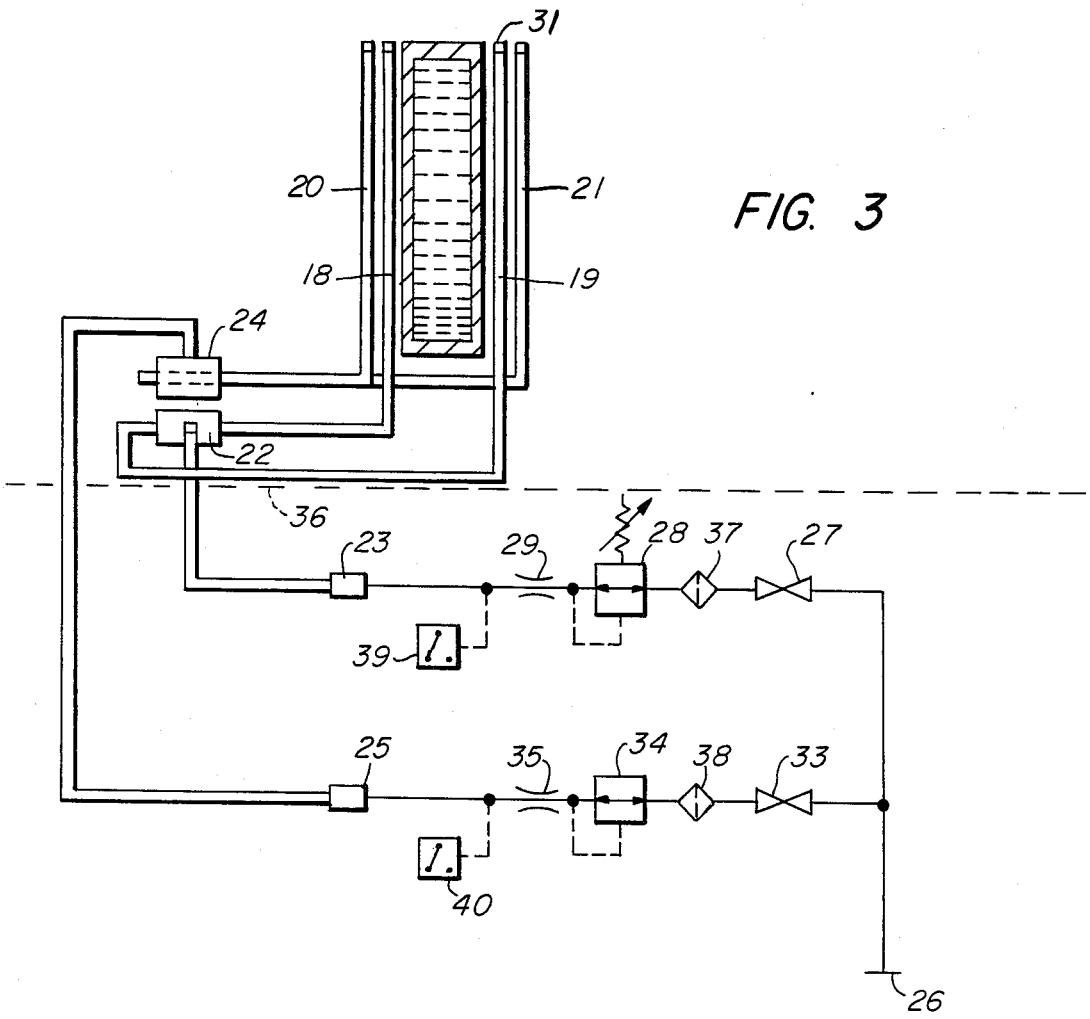
FIG. 3 is a schematic of an alternate circuit diagram showing a completely redundant system.

Referring to FIG. 2, each of the tubes 18 and 19 in the first pair is connected to a union 22 from which a third tube connecting both of the other two extends to a connector 23. Also, each tube 20 and 21 in the second pair is similarly connected to a union 24 from which a third tube connecting the other two extends to a connector 25. In this embodiment, a single control system is provided, to which only one of the connectors is attached at any given time. The control system includes fluid supply means comprising a source 26 of pressurized fluid, shut-off valve 27, pressure regulator 28 and flow control valve 29. Flow control valve 29 may be of either the fixed or variable orifice type. It serves to prevent false indications of a breakout from occurring in the event of undue leakage from the tube. A pressure switch 39 and filter 26 are also provided. Plugs 31 at least partially close, but preferably fully close the end of each tube opposite from that to which the fluid supply is connected. In the event that leakage is occurring in the first pair of tubes which connected to the fluid supply causing the pressure to drop significantly even though a breakout has not occurred, we disconnect those tubes and connect the other to the fluid supply. This serves as a backup system. Referring to FIG. 3 a completely redundant control system may be provided which comprises a second shut off valve 33, a second pressure regulator 34 and a second flow control valve 35. In both FIGS. 2 and 3 the fluid supply means and associated controls are located outside of the spray enclosure schematically illustrated by dashed line 36. Preferably, the fluid supply means provides pressurized air or inert gas to the tubes. Conceivably liquid could be provided instead of gas, but gas if preferred for safety reasons. Filters 37 and 38 are provided to remove foreign matter from the gas. Pressure switches 39 and 40 monitor pressure in the tubes during caster operation. The switches are set so as to provide an electrical signal when the pressure in the tubes drops to a significantly lower level than exists under normal conditions. Such a pressure drop occurs when molten metal 41 (FIG. 1) from a breakout in the strand flows onto the tubes and causes them to melt forming holes therein. A signal from pressure switches 39 and 40 may be used to activate an audible or visual alarm for the caster operator so that the supply of molten metal to the mold can be shut off. The signal from pressure switches mau also be used to automatically stop the flow of molten metal or trigger other control operations such as stopping flow to the tundish and the mold and/or slowing or stopping the caster rolls.

We claim:

1. An apparatus for determining if molten metal from the core of a partially solidified cast strand has broken through the outer shell thereof adjacent to a continuous caster mold, said apparatus comprising:

a hollow body positioned downstream from the mold adjacent to the cast strand at a location where a breakthrough may occur, said body having a melting point sufficiently below that of the molten metal being cast and a sufficiently thin wall thickness so as to fuse and form a hole through a wall thereof upon being contacted by said molten metal when a breakthrough has occurred, means connected for supplying fluid to the interior of said body at a substantially constant pressure, said fluid supply means including means for monitoring the pressure of fluid in said body, said monitoring means providing a signal indicating when a significant drop in the pressure of the fluid within said body has occurred, so that an early indication is provided of a breakthrough of the molten metal from the cast strand.

2. The apparatus of claim 1 wherein the hollow body is of metallic material.

3. The apparatus of claim 2 wherein said metallic hollow body comprises at least one elongated tube, said tube being at least partially closed at one end thereof, the other end of said tube being connected to said fluid supply means.

4. The apparatus of claim 3 wherein said fluid supply means includes a source of pressurized fluid, a fluid supply line connecting said source and said tube, and a flow control valve in said fluid supply line at a location between said source and said tube, said flow control valve serving to prevent false indications of breakouts from occurring due to leakage from the tube.

5. The apparatus of claim 3 wherein the molten metal being cast is steel and the tube is of material selected from the group consisting of copper, copper alloys, aluminum, aluminum alloys and mixtures thereof.

6. The apparatus of claim 4 wherein said monitoring means comprises a pressure switch for producing a signal when said pressure in the tube decreases to a predetermined level.

7. The apparatus of claim 4 wherein said flow control valve is a fixed orifice.

8. The apparatus of claim 4 further comprising two pair of tubes and the tubes in each pair arranged in parallel relation adjacent to opposed faces of the strand, one of the tubes in each pair being connected to said fluid supply means, the other of the tubes in each pair also being adopted for connection to said fluid supply means in the event of undue leakage in the first mentioned tubes thereof.

9. The apparatus of claim 5 wherein said tube is of material selected from the group consisting of copper and copper alloys.

10. The apparatus of claim 8 further comprising separate fluid supply means for each pair of tube.

* * * * *